United States Patent [19]

Sjöswärd

[11] 4,455,765

[45] Jun. 26, 1984

[54] SPORTS SHOE SOLES

[76] Inventor: Lars E. G. Sjöswärd, Hallekullevagen 16, S-430 80 Hovas, Sweden

[21] Appl. No.: 337,384

[22] Filed: Jan. 6, 1982

[51] Int. Cl.[3] ..... A43B 13/12; A43B 13/04; A43B 5/10

[52] U.S. Cl. ..... 36/30 R; 36/32 R; 36/114

[58] Field of Search ..... 36/30 R, 32 R, 114

[56] References Cited

U.S. PATENT DOCUMENTS

| | | | |
|---|---|---|---|
| 3,008,469 | 11/1961 | Welch | 36/32 R |
| 4,130,947 | 12/1978 | Denu | 36/30 R |
| 4,245,406 | 1/1981 | Landay et al. | 36/30 R |
| 4,366,634 | 1/1983 | Giese et al. | 36/32 R |

FOREIGN PATENT DOCUMENTS

| | | | |
|---|---|---|---|
| 2836793 | 3/1980 | Fed. Rep. of Germany | 36/32 R |
| 3015476 | 11/1981 | Fed. Rep. of Germany | 36/114 |
| 2007081 | 5/1979 | United Kingdom | 36/32 R |

*Primary Examiner*—James Kee Chi

*Attorney, Agent, or Firm*—Harness, Dickey & Pierce

[57] ABSTRACT

A sole for use in sports shoes, particularly tennis shoes. The sole comprises an insole, a midsole of a comparatively soft, compressible and resilient material, and an outsole. The latter is formed with a central portion of a compressible and resilient material possessing a high coefficient of friction, preferably rubber, while the rest of said outsole consists of a compressible and resilient material that is harder than the material of the midsole.

3 Claims, 2 Drawing Figures

SPORTS SHOE SOLES

BACKGROUND OF THE INVENTION

The subject invention relates to improvements in soles designed for use with sports shoes, particularly tennis shoes, said sole comprising an insole, a midsole of a comparatively soft compressible and resilient material, and an outsole.

Some sports are mostly practised on non-resilient surfaces, such as asphalt surfaces and concrete and wooden floors. One example of such sports is tennis. In the practice of this sport it is usually necessary for the player to move in all directions, alternating between rapid accelerating movements and sudden standstills. Movements of this kind on non-resilient surfaces put considerable stress above all on the ankles of the players.

Traditionally, sports shoe soles are made from rubber. This material is resilient and possesses a high coefficient of friction. However, the high weight of rubber is a drawback when used for soles and so is its "rebouncing" property, that is, it absorbs only a minor portion of the energy of impact when the foot hits the ground. This is a considerable disadvantage when the flooring surface is unresilient.

It is already known to provide sports shoes designed for playing on surfaces of this kind with a midsole of polyurethane plastics. Like rubber, this is a resilient material but in addition it possesses good shock-absorbing properties and also it is lighter than rubber. Compared with rubber, polyurethane has higher strength and wear-resistance but its frictionel properties are poorer.

For the purpose of improving the shock-absorbing qualities and increase the wear and strength of the sole the sports shoes manufactured today use polyurethane plastics for the midsole as well as for the outsole, the outsole being, however, slightly harder in order to provide sufficient wear resistance. Soles of this kind have proved to suffer from the disadvantage of being somewhat slippery when used in connection with certain types of surface, i.e. they do not provide sufficient grip or friction on the surface underfoot.

SUMMARY OF THE INVENTION

The purpose of the subject invention is to provide a sole for use with sports shoes, which sole possesses good shock-absorbing properties when used on unresilient floors or surfaces, good wear-resistance as well as excellent friction against all types of surfaces.

The sole in accordance with the invention is characterised in that the outsole is formed with a central portion of a compressible, resilient material possessing a high coefficient of friction, preferably rubber, while the rest of the outsole is made from a compressible and resilient material that is harder than the material of the midsole.

BRIEF DESCRIPTION OF THE DRAWINGS

The invention will be described in closer detail in the following with reference to one embodiment thereof illustrated in the accompanying drawings, wherein.

DETAILED DESCRIPTION OF A PREFERRED EMBODIMENT

Figure 1:
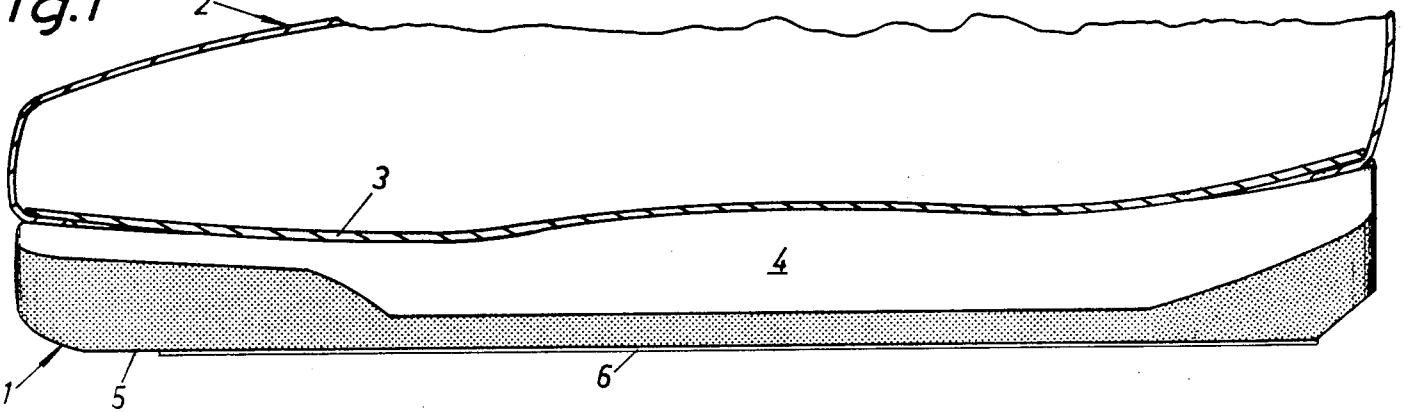
FIG. 1 is a lateral view of a part of a sports shoe provided with a sole in accordance with the invention, shown partly in section.
Figure 2:
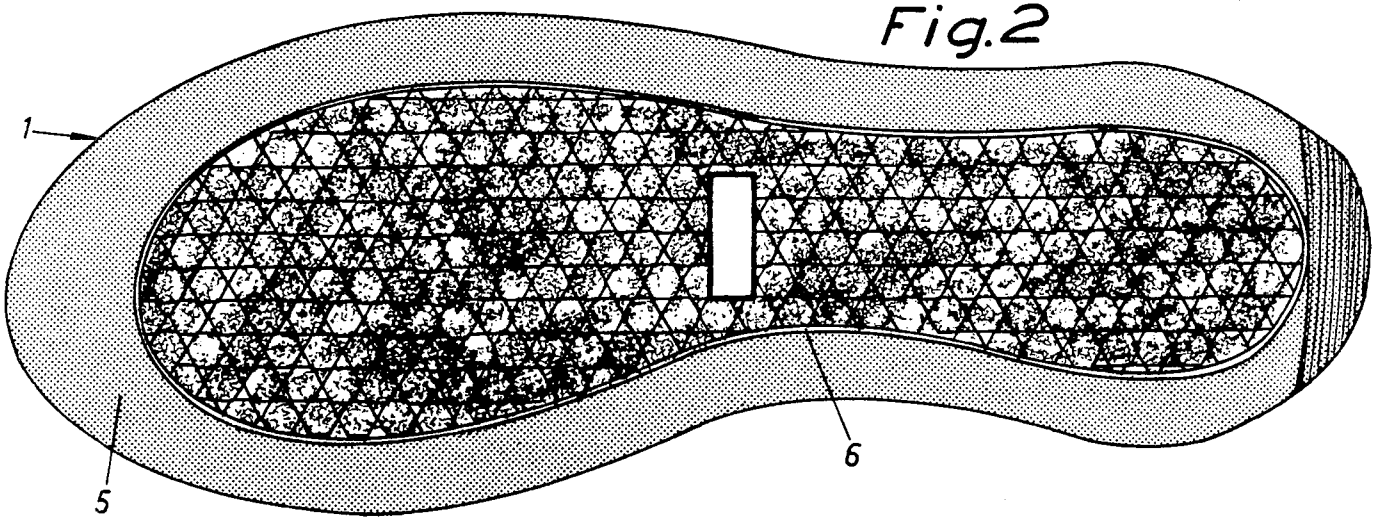
FIG. 2 is a view from underneath of the same sports shoe.

The shoe comprises a sole 1 and an upper 2 which are interconnected by means of an insole 3. In addition to the insole 3, the sole also comprises a midsole 4 and an outsole 5. The latter is formed with a central portion 6.

The midsole 4 is manufactured from a comparatively soft, compressible and resilient material, preferably some kind of polyurethane plastics. The marginal portion of the outsole 5 is manufactured from a harder, compressible and resilient material, preferably a kind of polyurethane that has higher density then the kind used to form the midsole. The central portion 6 is made from a resilient material possessing a high coefficient of friction, preferably rubber.

The soft midsole 4 is arranged to absorb the shock that is generated when the shoe at high speed hits a non-resilient surface. The marginal portion of the outsole 5 is harder but yet capable of absorbing shocks, in addition to which it is wear-resistant. Owing to the central portion 6 the sole 1 of the shoe has a firm grip on all types of surfaces. Because of the provision of the marginal portion wear on the central portion 6 is minimized and the central portion preferably projects somewhat below the marginal portion. When the foot hits the ground the central portion will be compressed and level with the marginal portion. This diminishes wear while at the same time preserving the frictional grip.

The sports shoe sole in accordance with the invention has proved to meet all demands regarding low weight, high wear-resistance and non-slip properties.

The invention is not limited to the embodiment described in the aforegoing but various modifications are possible within the scope of the appended claims. Other materials than those mentioned are possible for the midsole as well as for the central and marginal portions of the outsole, provided the properties are equivalent. The central portion 6 need not project below the marginal portion over its entire area but be provided with grooves or projecting studs.

What I claim is:

1. An improved sole for sports shoes, such as tennis shoes, comprising an insole adapted to be affixed to an upper, a midsole depending from said insole and formed of a comparatively soft, compressible and resilient material, and an outsole depending from said midsole and having a lower face for contacting the surface upon which the wearer is moving, the improvement comprising said lower face comprising a central portion terminating inwardly of the outer periphery of said lower face, said central portion consisting of a compressible and resilient material possessing a high coefficient of friction, preferably rubber, the remainder of said lower face of said outsole being formed from a compressible and resilient material that is harder than the material of said midsole and having a lower coefficient of friction than said central portion.

2. An improved sole according to claim 1, wherein said midsole and the remainder of said outsole are made from polyurethane plastics of different densities.

3. An improved sole according to any one of the preceding claims, wherein said central portion of said outsole projects somewhat below the rest of said outsole.

* * * * *